United States Patent [19]

Corgnet

[11] 3,961,490

[45] June 8, 1976

[54] ANCHORAGE OF FLOATING STRUCTURES

[75] Inventor: Jean-Louis Corgnet, Boulogne Billancourt, France

[73] Assignee: Compagnie Francaise des Petroles, Paris, France

[22] Filed: Dec. 23, 1974

[21] Appl. No.: 535,920

[30] Foreign Application Priority Data

| | | |
|---|---|---|
| Dec. 21, 1973 | Canada | 188913 |
| Apr. 30, 1974 | France | 74.14934 |
| Nov. 27, 1974 | France | 74.38886 |

[52] U.S. Cl. ..... 61/46.5; 61/69 R; 9/8 P; 114/230; 141/279; 141/387

[51] Int. Cl.[2] ..... E02D 21/00; B63B 21/00; B65B 3/04

[58] Field of Search ..... 61/46.5, 46, 69; 114/230, .5 D; 9/8; 141/279, 387, 388

[56] References Cited

UNITED STATES PATENTS

| | | | |
|---|---|---|---|
| 3,236,266 | 2/1966 | Bily | 141/279 X |
| 3,572,408 | 3/1971 | Hnot | 141/387 |
| 3,727,652 | 4/1973 | Reynolds | 141/387 |
| 3,739,589 | 6/1973 | Wolfe | 61/69 R |
| 3,774,253 | 11/1973 | Leoomte | 114/230 X |
| 3,782,458 | 1/1974 | Slack | 141/387 X |

*Primary Examiner*—Jacob Shapiro
*Attorney, Agent, or Firm*—Sughrue, Rothwell, Mion, Zinn & Macpeak

[57] ABSTRACT

A floating structure is anchored relative to the seabed by a rigid arm connected at one end to the structure and at the other end to a member, preferably in the form of an enclosure and including a watertight chamber for personnel, for pivotal movement about respective horizontal axes; the member is adapted to be releasably connected to an enclosure fixed in the seabed, defines with the enclosure a chamber to be placed at atmospheric pressure and is rotatable about a vertical axis relative to the enclosure. The arm may include damper means, e.g. in the form of a jack or a horizontal articulation of upper and lower arm parts.

53 Claims, 21 Drawing Figures

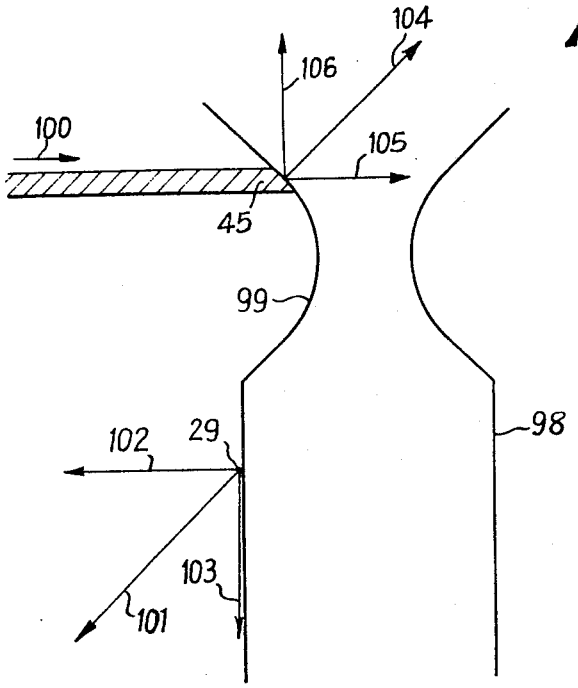
Fig:12
Fig:13
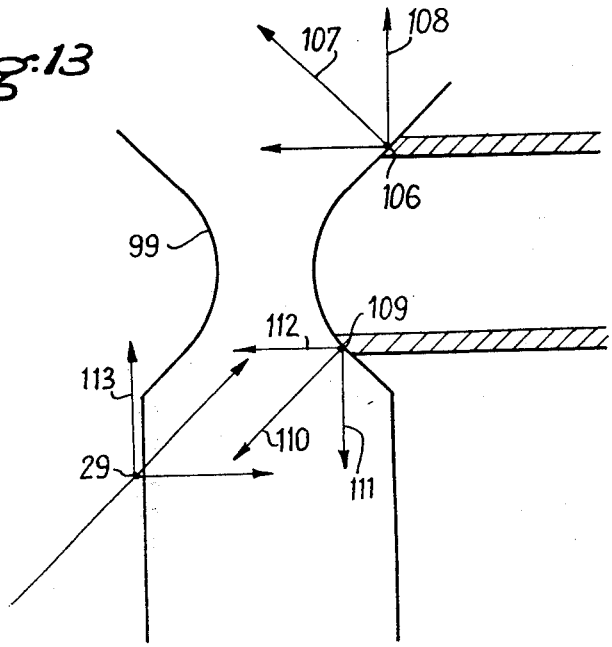

ANCHORAGE OF FLOATING STRUCTURES

The present invention is concerned with improvements in systems of anchorage of floating structures and in particular of semi-submersible platforms intended for use in the exploitation of oilfields in the sea.

A conventional system of anchorage of such a platform consists in immobilizing the platform above the site by a relatively large number of chains and anchors. However such a system, if it is simple for not very deep water, becomes impracticable at depths of several hundred metres because of the great weight of the chains and anchors.

Furthermore the operation of weighting anchor for the platform takes a long time and necessitates a service boat for raising each anchor, which could endanger the safety of the platform when one is compelled to remove it rapidly from the site because of a storm or in order to avoid its collision with an iceberg.

According to the present invention there is provided an assembly for anchorage of a floating structure comprising: a floating structure; a first enclosure having an opening at its top portion and arranged in the seabed; a movable member capable of being releasably connected in a watertight manner to said first enclosure so as to form with said first enclosure a watertight chamber capable of being brought to atmospheric pressure and having a top portion which is rotatable through 360° about a vertical axis and relative to a bottom portion; and rigid arm means extending from said movable member to said floating structure and pivotable about two horizontal axes by which its ends are attached respectively to said movable member and to said floating structure.

The effect caused by the difference between the hydrostatic pressure and atmospheric pressure created in the chamber on the sea bottom, which will exceed 35,000 metric tons for an enclosure of 15 metres diameter in a depth of 300 metres, and the possibility of the second member of this chamber revolving about a vertical axis through 360°, enables the arm means to exert on the floating structure a tensile force greater than that which can be exerted by any of the conventional anchors arranged round the floating structure and arranged to resist rotation of the floating structure under the action of thrusts exerted by the swell, winds, currents or ice.

Gathering of the outflow from wells in deposits located far from shore has hitherto been effected by individual or grouped pipelines bringing the outflow either to shore or to a structure including a pillar which rests on the seabed or on buoyant members and rises above the surface of the sea to support a platform upon which rest the first units for treatment of the outflow and devices for loading it on board tankers or gas-ships.

As to maintenance of the wells and supervision of the deposit, they are effected in accordance with the most recent systems, either in enclosures at atmospheric pressure resting permanently on the seabed and serving the wells located nearby, in smaller enclosures again at atmospheric pressure which cap each well during the time necessary for its maintenance, or finally by remote-controlled entirely automatic equipment brought from the surface to each well and withdrawn once the operations on the well have been concluded.

An embodiment of apparatus according to the present invention may also be employed as a means of conveying the production of wells from the seabed to a platform where it will be stored and removed by tankers or gas-ships, and as a means of maintenance and supervision of the wells, by arranging the second member as an enclosure capable of being brought to atmospheric pressure, containing all the checking and control instruments necessary to the maintenance and supervision of the wells, and into the interior of which crews for supervision of the deposit can enter and work.

To maintain the platform in a position of horizontal stability whatever the state of the sea and whether it is free or has become frozen, a strut may be provided between the arm means and floating structure and the upper portions of the columns may be specially shaped.

To increase the ability of the arm means to absorb longitudinal thrusts thereon, the arm means may include damper means, for example in the form of a jack or a horizontal articulation of an upper and lower arm part.

The invention will become more apparent from the following description of embodiments thereof, given by way of example only, with reference to the accompanying drawings, in which:

FIGS. 12 and 13 are sections through part of the floating structure showing the forces exerted thereon by an icepack;

Figure 9:
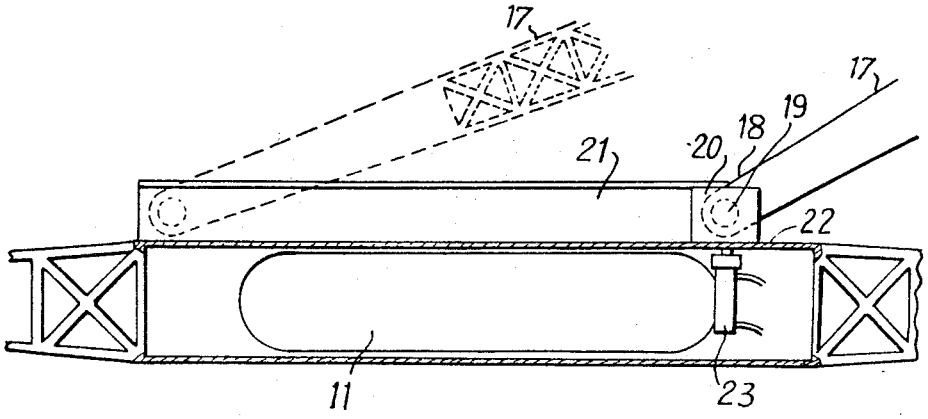
FIG. 9 is a view partly in section of part of the arm means.
Figure 1:
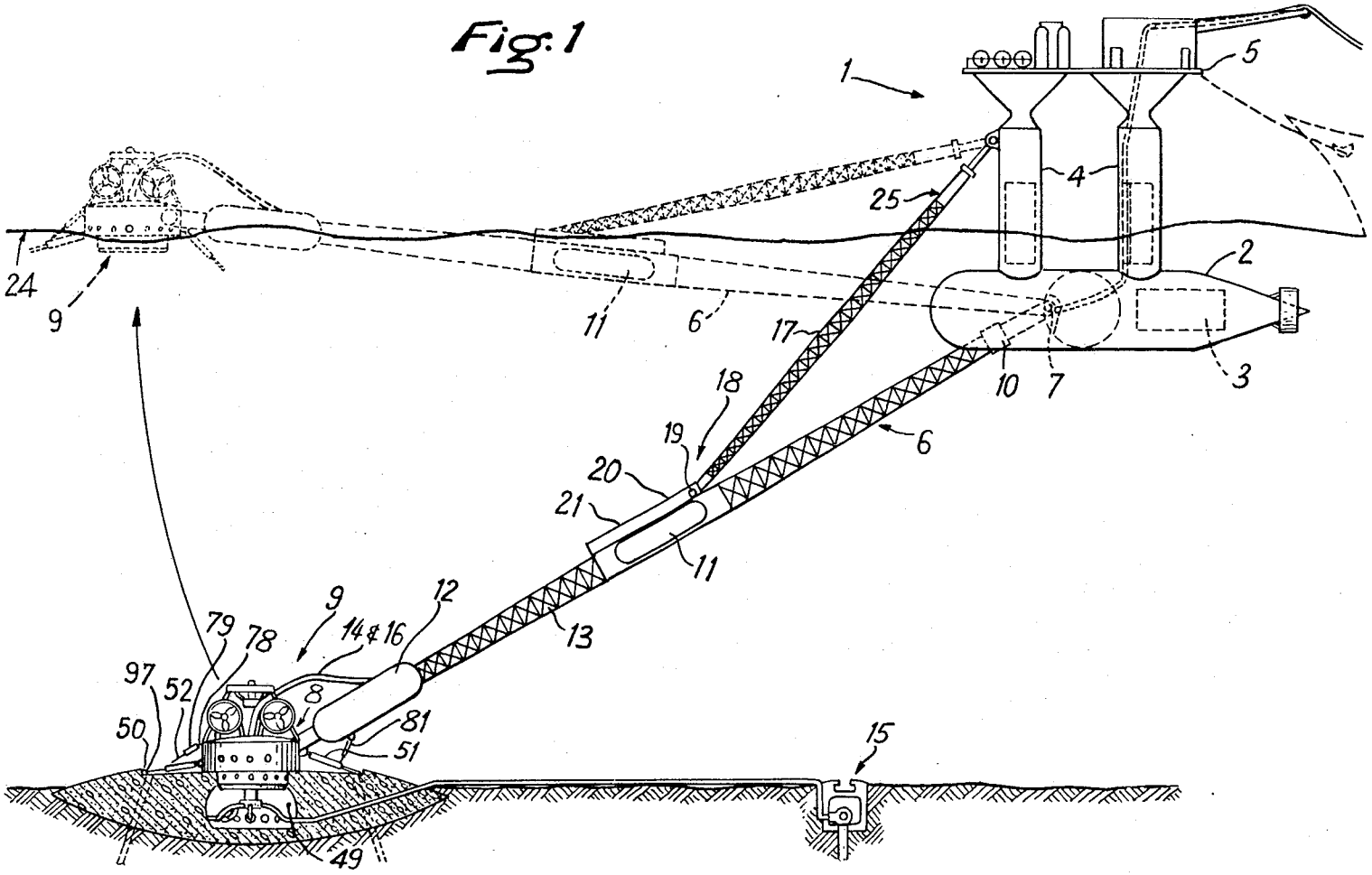
FIG. 1 is a general view, partially in section, of an embodiment according to the invention in a raised position when the sea is free of ice.
Figure 2:
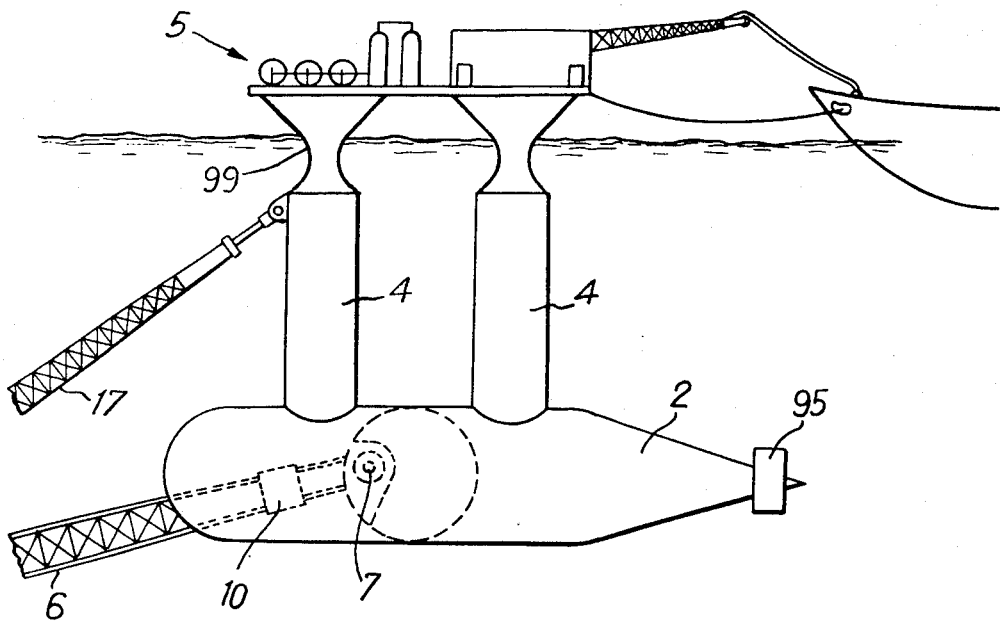
FIG. 2 is a general view of part of the embodiment of FIG. 1 in a lowered position when the sea has become frozen.
Figure 3:
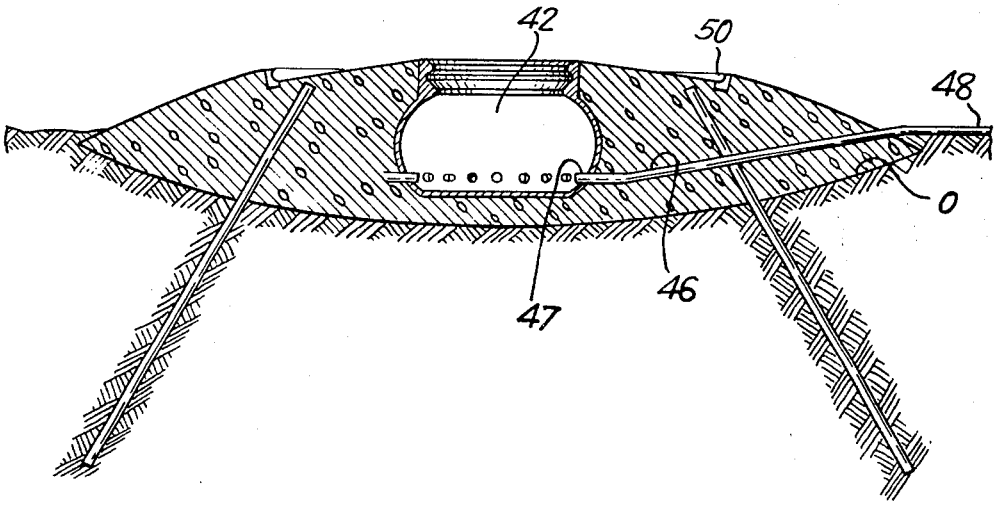
FIG. 3 is a vertical section through the first enclosure permanently fixed in the seabed.
Figure 4:
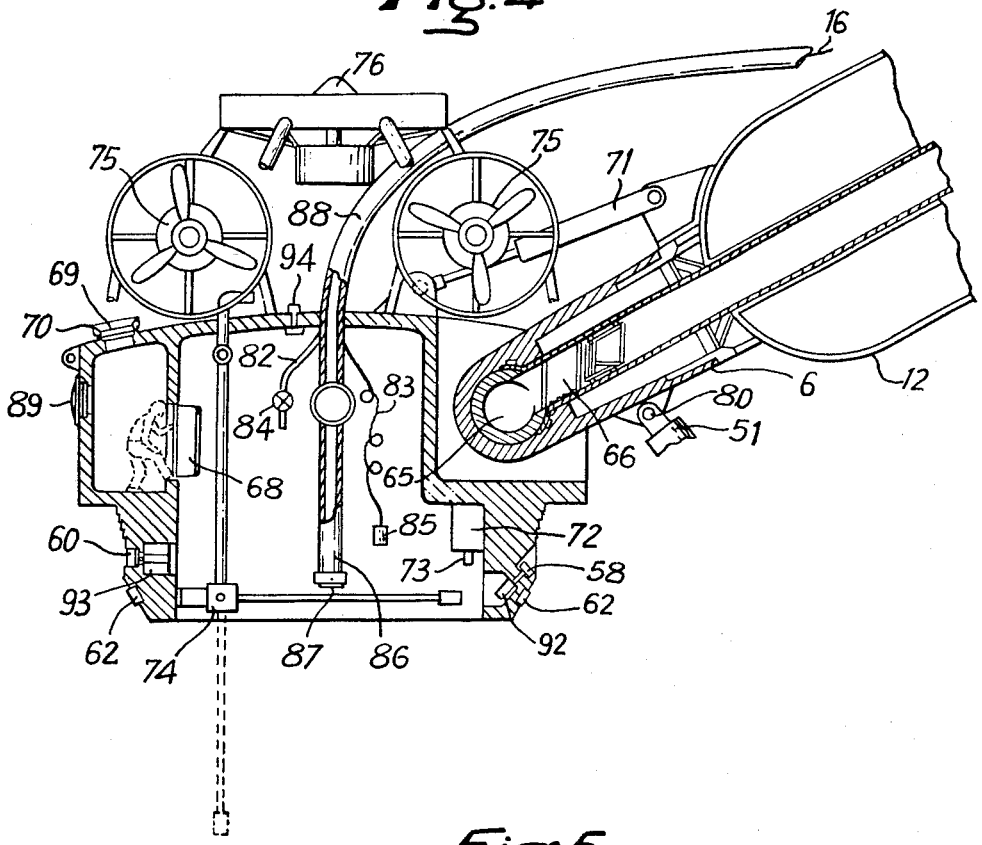
FIG. 4 is a vertical section through the movable member to be connected to the first enclosure.
Figure 5:
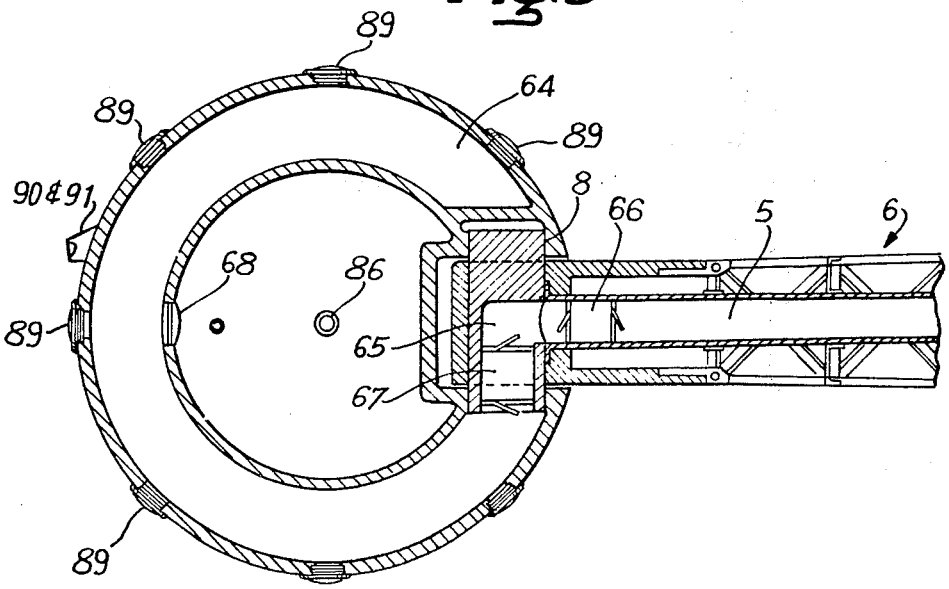
FIG. 5 is a horizontal section through the movable member.
Figure 10:
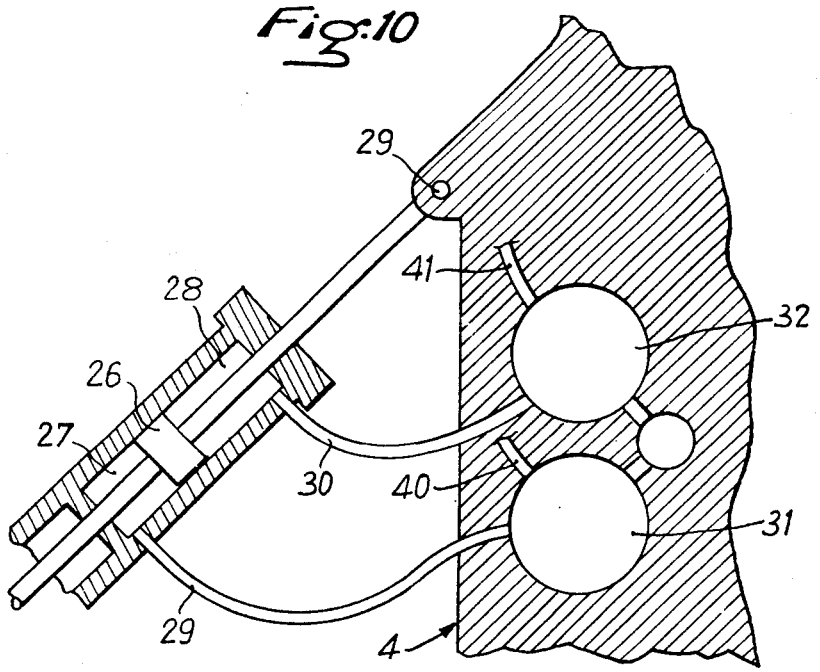
FIG. 10 is a section through the connection of the arm means to the floating structure.

The apparatus of FIGS. 1 to 3 comprises a floating structure 1 including a buoyant member 2 which contains tanks 3 (FIG. 1) for storage of the outflow from one or more wells 15, and two columns 4 supporting a platform 5 which supports conventional installations for production of a deposit, crude separation units, a flare, generators, staff living-quarters, a helicopter platform, ship loading installations, etc., which have been shown diagrammatically, A rigid arm 6 consisting of a lattice girder, whose profile is doubly tapered from its centre towards each of its ends in order to avoid buckling, is connected to the structure 1 for pivotal movement about a horizontal axis 7 (FIGS. 1 and 11) and is connected to an enclosure or anchoring cap 9 for pivotal movement about a horizontal axis 8 (FIG. 1, 4 and 5). The arm includes a swivel joint 10 which enables torsional forces due to rolling of the structure 1 to be avoided, a buoyant body 11 located halfway along the arm enables its apparent weight in its particularly heavy central portion to be reduced, and a second buoyant body 12 enables its buoyancy and that of the anchoring-cap to be adjusted. The arm 6 encloses a watertight passage way 13 for men to pass through, moving in a lift (not shown) from the structure to the anchoring-cap, as well as pipework 14 for the outflow from one or more wells 15, the pipes and circuits 16 for admission of air, remote control and telecommunication from the structure 1 to the cap. A strut 17 which may be a solid or lattice steelgirder of the same doubly tapered profile as the arm, connects the arm to the top portion of one of the columns 4. Its bottom end 18 (FIGS. 1 and 9) is pivotable about an axis 19 on a carriage 20 which is slidable along a slide 21 fixed on the arm. A bolt 22 moved by a jack 23 locks the carriage in its working position. The carriage is unlocked so that it can move freely along the slide when the arm is raised in order to bring the cap 9 to the surface of the sea 24 during maintenance operations on the cap and the control and checking devices located inside it. The top end 25 (FIG. 10) of the strut 17 is connected to the column 4 by a jack the piston 26 of which moves in cylinder defining chambers 27 and 28, the end of the piston rod being pivotable about a horizontal axis 29 in the column 4. The chambers 27 and 28 of the cylinder are filled with oil through pipes 29 and 30 from balance chambers 31 and 32 in which the oil is kept at different pressures. The pressure differential depends on the force which it is necessary to apply to one of the two faces of the piston so that, depending on the direction of movement of the piston in the cylinder, the distance between the axes 29 and 19 (FIG. 9), increases or decreases thus enabling, because of the torque formed by the forces applied to the axis 7 at the end of the arm and the axis 29 at the end of the jack on the strut, the platform 5 to be maintained in a horizontal position regardless of the swell or the wind.

In winter when the sea becomes frozen and pack ice exerts a thrust against the columns, the action of the strut in keeping the platform in a horizontal position is essential. It can be seen from FIG. 2 that it is possible to lower the level of the platform in winter because there is no longer the risk of the platform being swept by the sea. The distance between the axis 7 of attachment of the arm to the structure 1 and the point of application 45 (FIG. 12) of the thrust of the ice against the column is increased and the torque tending to turn the platform over is therefore much greater.

The stability of the platform is also increased by the profile given to the top portion of the columns at the winter flotation level of the columns. FIG. 12 shows the forces exerted on a column having a cylindrical profile 98 by the pack ice, the ice exerting a thrust in the direction of the arrow 100, that is to say, in a direction opposite to the direction of the tensile force exerted by the strut at its point of attachment 29. In this case the tensile force 101 from the strut can be resolved into a force 102 parallel with and in the opposite direction to the force 100, and a force 103 perpendicular to the force 100 and directed downwards. This force tends to sink the platform. However the longitudinal profile of the column has constricted shape 99, the generatrix of which is substantially a hyperbola and the position of which on the column is such that the top portion of the constriction is level with the thrust exerted by the pack ice at point 45. This thrust from the pack ice is exerted on the column as a force 104 in a direction perpendicular to the tangent to the generatrix at the point of contact 45. The force 104 may be resolved into a horizontal force 105 and a force 106 perpendicular to the thrust 100 of the pack ice and directed upwards. It can be seen that the tensile force 101 exerted at point 29 by the strut has the effect of keeping the platform in a stable dynamic position.

In the event that the pack ice exerts a force on the column in the opposite direction, which can only be accidental because the platform will normally pivot about the anchoring cap if the thrust of the pack ice is not exactly in the plane of the axis of pivoting at the instant at which the force is exerted, the resultant forces are as shown diagrammatically in FIG. 13. The pack ice applies its thrust at point 106; the force 107 which the pack ice exerts perpendicular to the tangent to the hyperbola at the point of application of the thrust is resolved into two forces of which the one, 108, tends to raise the level of the platform. This lifting continues until the point of application of the thrust of the pack ice lies at point 109. The force then exerted by the pack ice can be resolved into two forces of which one force 111 is directed downwards. The opposite force 112 being applied by the anchoring arm to the column at point 29 can be resolved into two forces of which one force 113 is equal and opposite to the force 111, thus achieving dynamic equilibrium of the platform. In the situation of FIG. 12 as in that of FIG. 13, the force applied by the arm at point 7 opposes the capsizing torque resulting from the application of the forces at points 29 and 45, 106 or 109. This device may be an electronic device subordinated to a sensor of the horizontal positioning of the platform. In calm weather the electronic device can be switched out and the device functions in this case as a simple orifice damping the variations in pressure between one chamber and the other.

Figure 11:
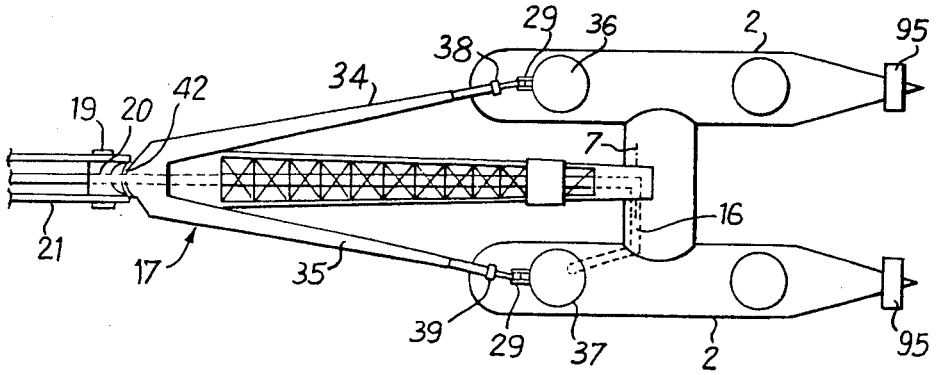
FIG. 11 is a general plan view of part of the floating structure and its connection to the arm means.

As shown in FIG. 11, the floating structure has two buoyant members 2. In this case the strut 17 has the form of a Y the two arms 34 and 35 of which are joined at the level of the carriage 20 to a common portion provided with a swivel joint 42 to avoid the forces of torsion due to rolling of the structure 1, and are connected to corresponding columns 36 and 37 by jacks 38 and 39. The same pressure differential is maintained between the two chambers feeding the jack 38 of column 36 and the two chambers feeding the jack 39 of column 37 by placing the chambers in communication in pairs by pipes 40 and 41.

Figure 6:
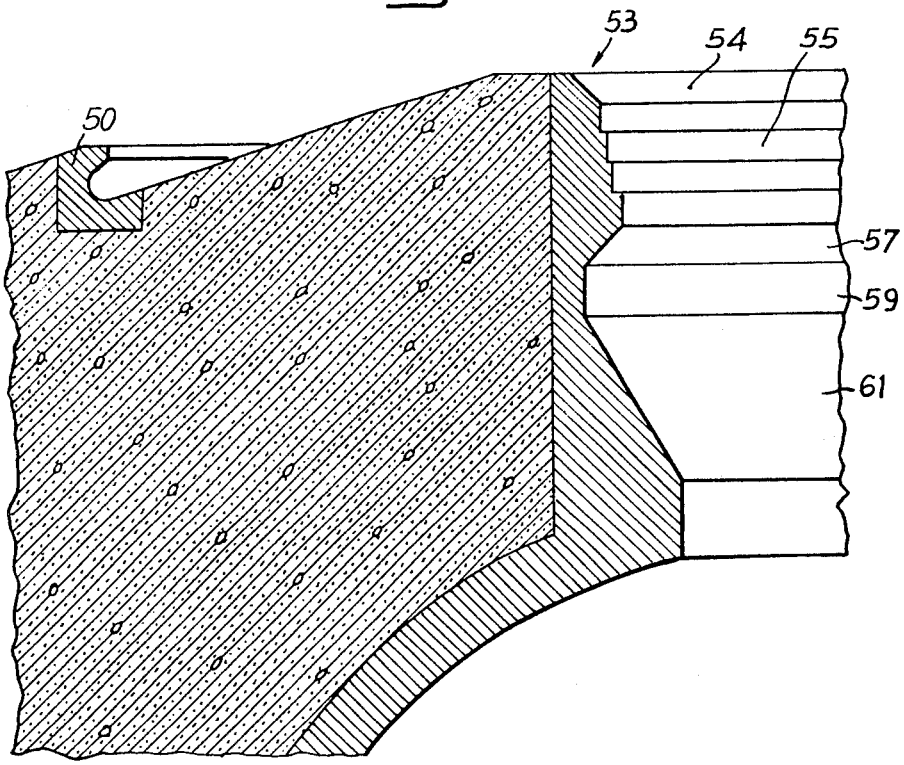
FIG. 6 is a vertical section through part of the first enclosure.
Figure 7:
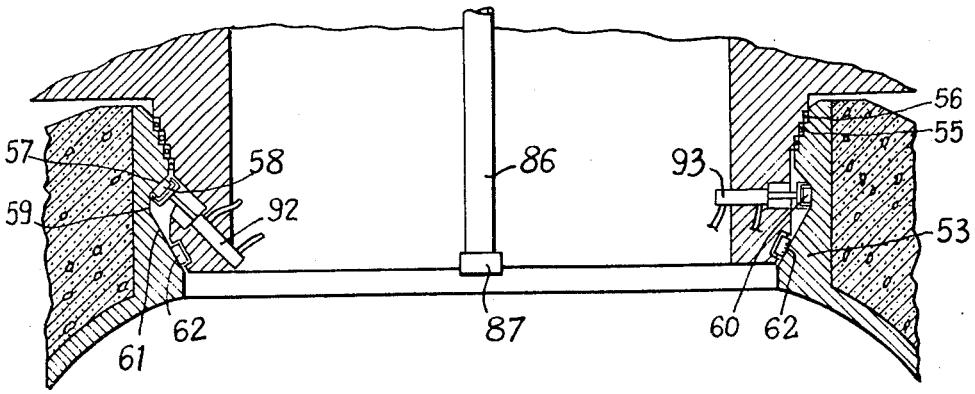
FIG. 7 is a vertical section through parts of the first enclosure and member when connected together.

As can be seen in FIG. 3, a first enclosure 42 is provided in a lens-shaped reinforced concrete block which offers the least possible hold to icebergs which may scrape the seabed. This block is preferably anchored in a dip 45 by a number of piles sunk into the seabed by driving or any other known technique. Passages 46 are formed in the block and connect by means of connectors 47, pipes 48 bringing the outflow from the wells 15 to a manifold 49 inside the enclosure 42. In the top portion of the concrete block there is provided a steel element having a recess 50 coaxial the vertical axis of the enclosure, and serving as a purchase for two jacks 51 and 52, (FIG. 8), on the anchoring-cap 9. The top portion of the chamber 42 is open and has a circular bearing surface 53 of steel against which the bottom portion of the anchoring cap bears for relative rotation about a vertical axis. The bearing surface 53 (FIG. 6) includes a guide-cone 54 for the final approach of the cap, a stepped cylindrical portion 55 against which watertight seals 56 on the cap are applied (FIG. 7), a bearing surface 57 for conical locking rollers 58 on the cap (FIG. 7), a bearing surface 59 for cylindrical rollers 60, applying opposing horizontal forces on the cap, and a bearing surface 61 for conical rollers 62 on the cap. These rollers 62 apply to the bearing surface 61, not only the weight of the cap, but also the hydrostatic pressure once the enclosure 42 and the cap 9 have been brought to atmospheric pressure. These rollers 62 may be regarded as replacing the anchors of conventional anchorage devices.

Jacks 92 and 93 (FIGS. 4 and 7) are provided for controlling the retractable lateral rollers 60 and oblique rollers 58 and apply these rollers against their respective bearing surfaces when the rollers 62 rest on their bearing surface 61.

The anchoring-cap 9 consists of a metal structure defining a hollow toroid ring 64 in its peripheral portion and which is interrupted at the level of the axis 8 of the arm, is maintained at atmospheric pressure and communicates with the passageway 13 (FIG. 5) in the arm 6 by means of a passage 65 arranged in the pivot 8 of the arm. The passageway 13 and the passage 65 are closed by airlocks 66 and 67. A door 68 (FIG. 4) enables access from the ring 64 into an inner enclosure in the cap after its watertight connection with the enclosure 42, and after the cap and enclosure have been brought to atmospheric pressure, and after safety checks have been concluded. An escape door 69 and a clamping platform 70 for a submarine enable evacuation of the personnel in the event of damage to the cap. A valve 94 at the top portion of the cap, controls the opening of an aperture for the inlet of water into the chamber defined by the cap and enclosure during disconnection operation of the cap and enclosure.

The horizontal position of the cap is obtained by operation of a jack 71 bearing against the top of the cap and against the arm.

A small decompression chamber 72 at atmospheric pressure before connection of the cap to the enclosure enables the chamber formed by the cap 9 and the enclosure 42, when connected together, to be substantially instantaneously brought to atmospheric pressure merely by opening a valve 73, water contained in the chamber rushing into chamber 72. A high-pressure pump 74 having an articulated pipe enables water to be exhausted to the outside after connection of the cap and the enclosure.

Two horizontal-axis propellers 75 and one vertical-axis propeller 76 are mounted at the top of the cap. On the lower portion of the cap opposite the axis 8 of the arm and in the plane of the longitudinal axis of the arm is mounted the jack 52 one end of which is pivotable about a horizontal axis 78 on the cap and the other end of which is intended to bear against the recess 50. Rotation of the jack 52 about its axis 78 is effected by an auxiliary jack 79 bearing against the side of the cap adjacent the top. Similarly rotation of jack 51 (FIG. 8) about its horizontal axis 80 on the end of the arm is effected by an auxiliary jack 81 bearing against the arm.

In the inner enclosure of the anchoring cap besides the pump 74 there are flexible pipes, one of which is shown at 82 (FIG. 4) and is the air inlet from the floating structure 1, and electric cables one of which is shown at 83, with valves 84 and connectors 85 respectively ready for connection to corresponding circuits of the manifold 49. Rigid pipework 86 is for connection by a swivel joint 87 to a pipe from the manifold carrying the whole of the production of the wells 15. All these circuits and pipes are collected at the top of the cap with the remote control and telecommunication circuits into a lyre-shaped flexible bundle 88 which constitutes the point of departure of the circuits 16 extending through the arm 6 to the platform. Portholes 89, searchlights 90 and sonar depth gauges 91 are arranged on the outside of the ring 64.

The ring 64 contains all the conventional devices (not shown) enabling piloting (operation and control of the main propellers 95 on the buoyant members 2 and the vertical and transverse propellers on the cap, operation and control of the buoyancy of the buoyant bodies 11, 12 on the arm, control of the jack 71 for the horizontal position of the cap, television screen, sonar screen, telephone to the platform), connection of the cap and enclosure, bringing to atmospheric pressure of the chamber defined thereby and disconnection of the cap and enclosure (operation and control of the horizontal and oblique jacks 92, 93, the valve 73 on the decompression chambers 72, the exhaust pump 74 and its suction pipe, the air inlet pipe 82, control of the pressure and the composition of the gases in the chamber when the cap and the enclosure 42 are connected, control of the tension in the arm and the pressure against the rollers 62, operation and control of the jacks 51, 52 and their auxiliary jacks 79, 81, and control of the water inlet valve 94), finally those devices for control of the wells which are too fragile to be located in the enclosure 42 where there are only left valves operable by hand. In order to connect the cap to the enclosure the crew in the ring 64 must perform the following operations. The buoyancy of the buoyant bodies in the arm is adjusted so that the buoyancy of the arm and the cap is zero. The cap is brought into a horizontal position vertically above the enclosure 42 by operation of the jack 71 and the propellers 75, 94. The lower end of the cap is moved into guide cone 54 using the sonar equipment, the television and visually through the portholes using the searchlights. Once the rollers 62 are in position, the valve 94 is closed, valve 94 having been kept open to enable escape of the water from the enclosure 42 which has been displaced during lowering of the lower end of the anchoring-cap into the opening in the enclosure. The valve 73 of the decompression chamber 72 is opened. The horizontal and oblique jacks 92, 93 are actuated. The chamber defined by the cap and enclosure is emptied of water and at the same time air is brought in through the flexible pipe from the platform. The decompression chamber 72 is emptied and the valve 73 is closed. The atmosphere in the chamber is checked to ensure that it is non-poisonous and not explosive (possible leakage from the manifold). The crew then enter the chamber through the door 68 in the cap and connect up the pipes and cables to the corresponding pipes and cables on the manifold 49. The crew can next proceed with conventional operations of checking and maintenance of the wells 15.

Disconnection operations are as above but are carried out in the reverse order. However disconnection may be decided on as a result of a tension or compression of the arm which is judged to be dangerous, caused by the state of the sea, currents, storms, pressure of pack ice against the columns of the structure 1 etc.

Figure 8:
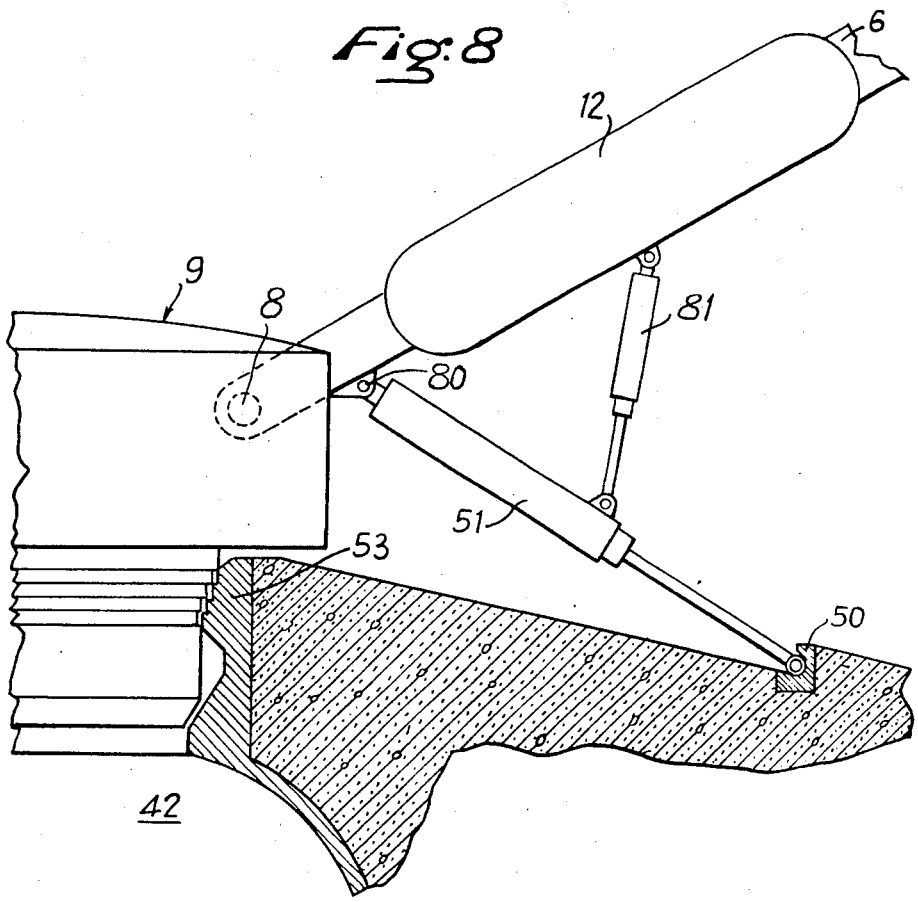
FIG. 8 is a view partly in section showing part of the connection of the first enclosure and member.

The sequence of operations then differs slightly depending upon whether disconnection is carried out when the arm is in tension or compression. When the arm is in tension, the sequence of operations is the following. The buoyancy of the arm and the cap is checked to ensure that it is exactly that which was indicated on the control panel in the ring during connection (buoyancy zero). The pipes and cables are disconnected from the manifold. The crew return to the ring. The chamber is filled almost completely with water. The jack 51 is lowered by operation of the jack 81 until its end 96 comes to bear against the recess 50 (FIG. 8). The jack 51 is then actuated to balance the tensile force on the arm. The oblique and horizontal jacks 93 and 92 are retracted and the water inlet valve 94 is opened in order to equalize the pressures. The cap is detached and raised by operation of the propeller 76 with the assistance as necessary of the jack 51 in the event that the tension in the arm had not been sufficiently balanced. Finally the jack 51 is retracted and raised.

When the arm is in compression (a sudden thrust outside the safety limits of the elements against the structure 1 from the rear before the structure has had time to reposition itself head to wind or to the pack ice after pivoting of the arm by 180° round the cap) the sequence is the same except that use is made of the jack 52 which is lowered by operation of the jack 79 until its end 97 comes to bear against the recess 50 and it is actuated to balance the thrust of the arm. The jack 51 is also lowered and actuated in order to bear slightly against the cap, the jack 52 is then actuated to balance the sum of the two thrusts of the arm and the jack 51, which causes separation of the cap from the enclosure after retraction of the jacks 92 and 93, opening of the water inlet valve 94 and equalization of the pressures.

The above described apparatus may of course be modified. For example a different profile might be used for the connection portions 54 to 59 of the enclosure and the corresponding portions of the cap. Similarly the arrival and departure of the work-crew may be effected not by an access passageway in the anchoring-arm, but by a submarine or a personnel-transfer chamber which is coupled to the clamping platform 70.

The apparatus of FIGS. 14 to 19 comprises a floating structure including a platform 201 supported by columns 203 and one or more buoyant members 202 provided with all the appropriate tanks, as has been described with reference to the first embodiment. The connection of the upper end of the anchoring-arm 205 to the member 202 is also as previously described. In this embodiment the arm 205 comprises an upper part 204 and a lower part 208. The upper part 204 is pivotable about horizontal axis 206 through swivel joint 207. The upper and lower parts 204, 208 are articulated and pivot relatively about a horizontal axis 209. The lower part 208 is connected to anchoring-cap 210 for pivotal movement about horizontal axis 211 (FIG. 15) as in the previously described embodiment.

Figure 14:
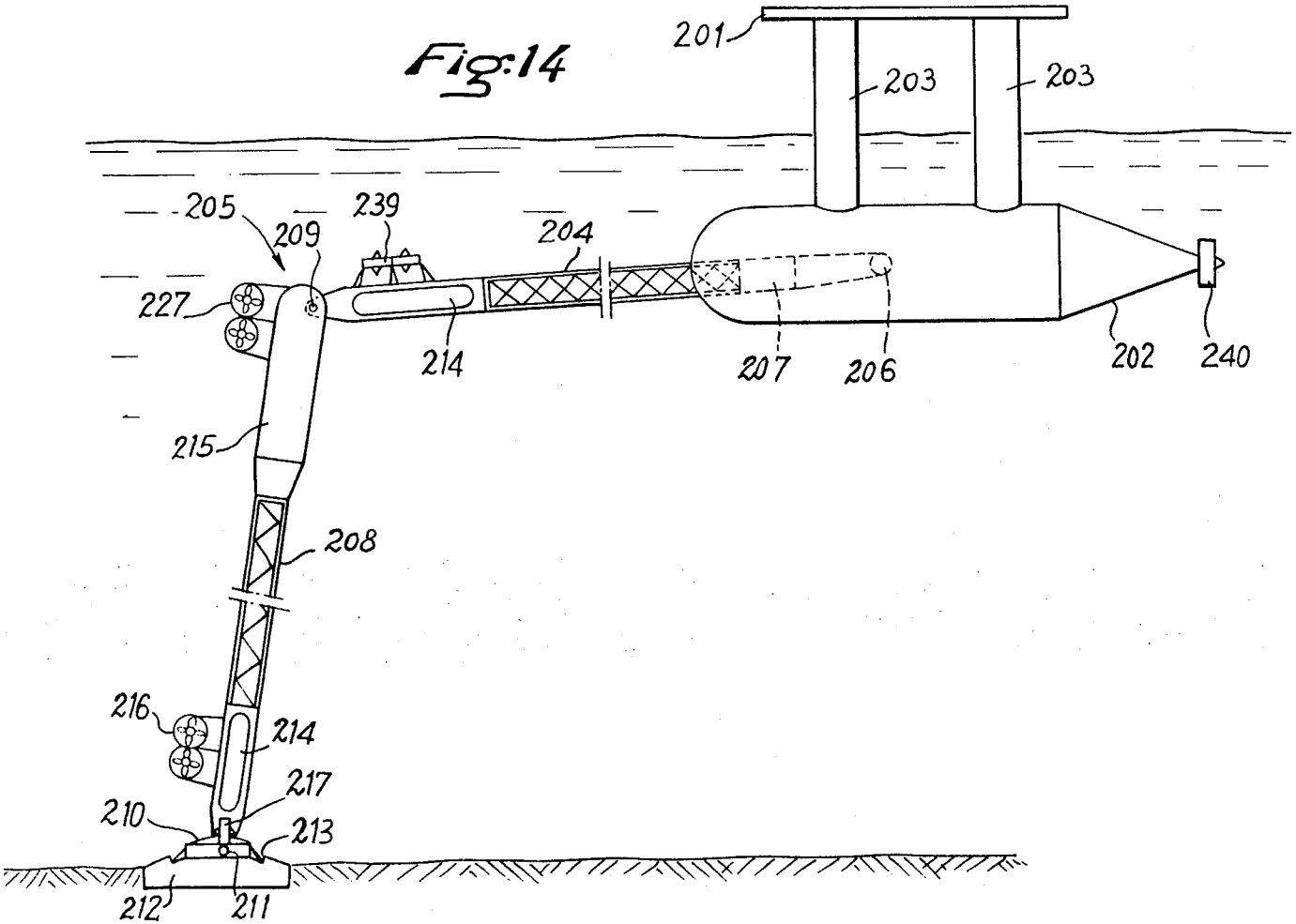
FIG. 14 is a general diagrammatic elevation of a second embodiment according to the invention.
Figure 15:
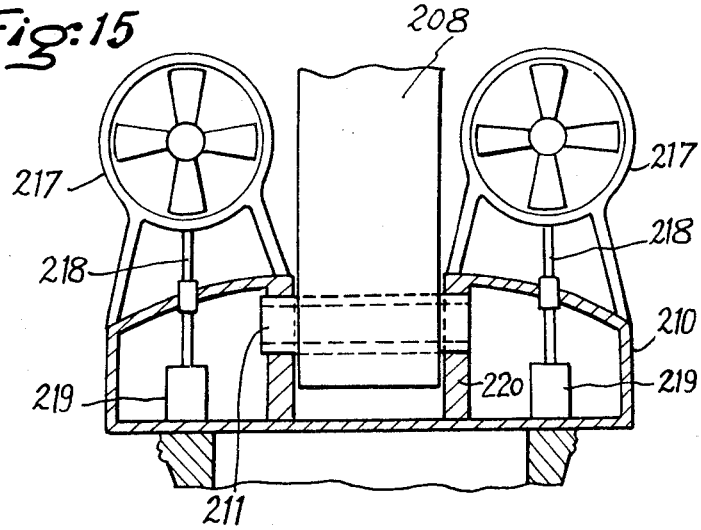
FIG. 15 is a diagrammatic front view, partly in section, of the top portion of the movable member of the apparatus of FIG. 14.
Figure 16:
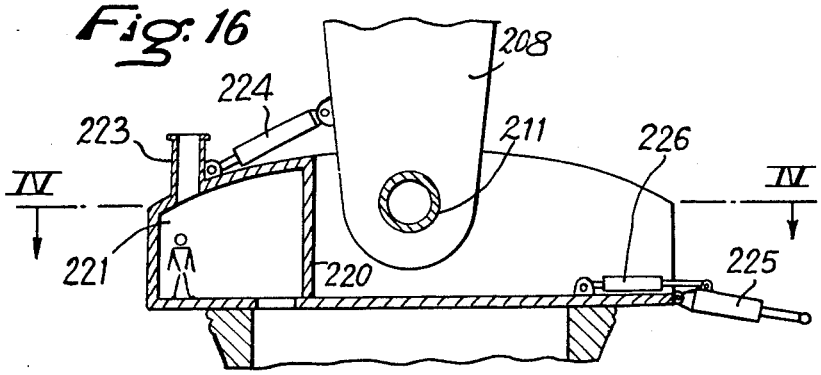
FIG. 16 is a diagrammatic side view of the part of the movable member shown in FIG. 15.
Figure 17:
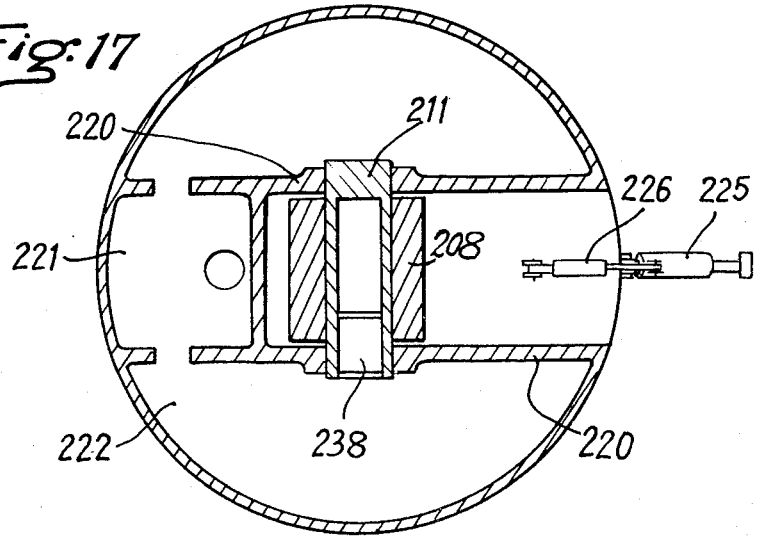
FIG. 17 is a section on the line XVII-XVII in FIG. 16.
Figure 18:
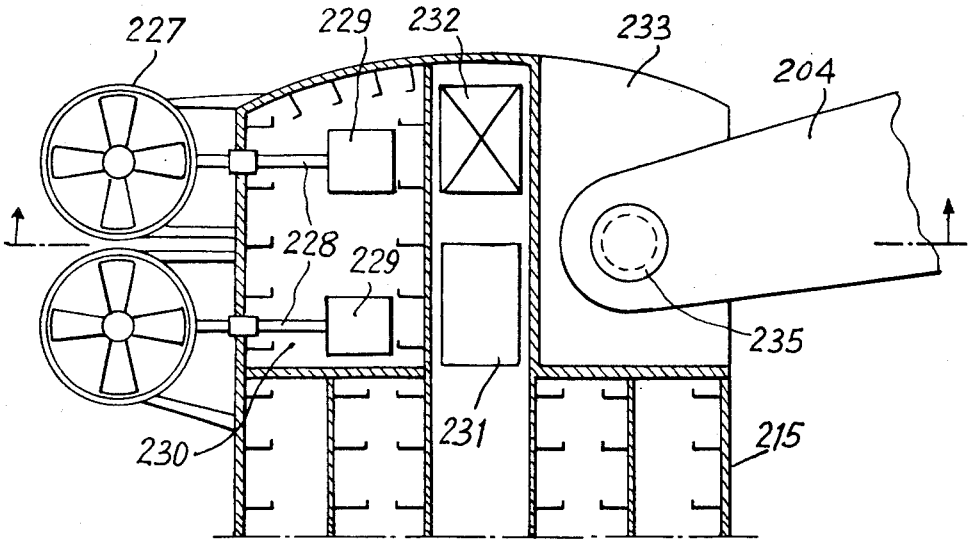
FIG. 18 is a diagrammatic view in section of a portion of the arm means of the embodiment of FIG. 14.
Figure 19:
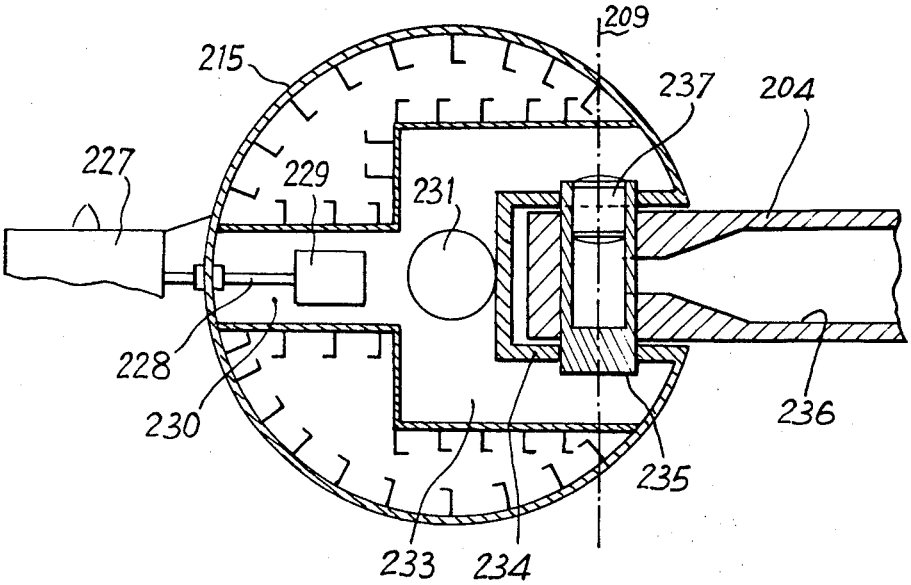
FIG. 19 is a section on the line XIX-XIX of FIG. 18.

As the method and means of connecting the cap 210 to the first enclosure is identical to that of the previously described embodiment, the lower end of the cap 210 and the second enclosure are not shown in detail. The steel recess 213, however, is shown in FIG. 14 as is the concrete body 212 in which the first enclosure is formed.

As in the previous embodiment the anchoringarm 205 has in its lower portion a buoyant body 214 enabling the buoyancy of the lower end of the arm to be adjusted during positioning of the anchoring-cap 210 on the first enclosure.

The arm 205 also has in its central portion another buoyant body 214 adjacent the axis 209 and enabling lightening of the arm.

Additionally the arm 205 is permanently lightened by a buoyant body or mainfloat 215 at the end of which is fixed the horizontal axis 209 about which the upper arm part 204 pivots.

Thus, with the arm 205 pivoting at its ends about the horizontal axes 206 and 211 and in its middle portion about axis 209, it can be seen that it is sufficient to connect the cap 210 to the first enclosure as explained with reference to the first embodiment. It will be seen that even in the case of high seas the forces generated are not, in this embodiment, absorbed directly by the structure of the arm 205 but that these forces are largely weakened by the movements which the arm 205 undergoes with each large wave. In short, having given a certain flexibility to the anchoring-arm 205 and because of the high buoyancy of the main float 215, it can be seen that any longitudinal translational movement separating the structure from the second enclosure will cause a tilting and a slight sinking of the float 215, the float 215 tending to bring the whole back progressively to its original position as soon as the force which has brought about this translation is removed. Further, even in the event of abrupt reversal of the force bringing the platform back towards its original position the cap and enclosure and structure no longer undergo violent impacts.

In order further to reduce the forces exerted on the anchoring-arm 205 and to facilitate placing of the anchoring-cap 210, the arm part 208 is dimensioned such that when it lies in the vertical position the arm part 204 lies in a substantially horizontal position in alignment with the propeller 240 on the buoyant member 202. Thus the axis of thrust of the or each propeller 240 lies substantially in the plane of the horizontal axes 206 and 209.

The means for positioning the anchoring-cap 210 on the first enclosure are similar to those described in connection with the first embodiment. However, in order to enable greater angular folding down of the arm part 208, the transverse propellers 216 have been displaced and mounted at the side of the lower variable buoyant body 214. The arm part 208 furthermore is centred in its vertical position with respect to the central portion of the cap 210 between two longitudinal propellers 217 having a direction of thrust parallel with that of the or each propeller 240 once the cap has been put in place. The propellers 217 are driven via shafts 218 by electric motors 219. Partitions 220 define a control chamber 221 of which portions 222 are reserved for motors and other equipment which are not shown.

In the vicinity of an airlock 223 a jack 224 is connected both to the arm part 208 and the anchoring-cap 210 and is provided for adjusting the attitude of the cap 210. The use of jack 225 for bearing against the recess 213 and jack 226 for moving the jack 225 has already been explained with reference to the first embodiment.

The top portion of the main float 215 (FIGS. 18 and 19) has transverse propellers 227 located substantially on the axis of the upper arm part 204 and driven via shafts 228 by motors 229 in compartment 230. In the central portion of the float there is shown the cage 231 of a lift controlled by machinery 232 and accessible from chamber 233, the water-tightness of which is ensured by partition 234. The arm part 204 fixed to a hollow cylinder 235 pivots in a suitable bearing in the partition 234 about the axis 209 of the cylinder 235. The access-tunnel 236 ends inside the cylinder 235 which has an airlock 237 giving access to the chamber 233. Thus access can easily be gained to the control chamber 221 (FIG. 17) through a corresponding tunnel in the arm part 208 ending in an airlock 238 inside pin 211.

In order to facilitate placing of the anchoring-cap 210 there are also provided at the end of the arm part 204 near its pivot 209 propellers 239 having vertical axes.

Figure 20:
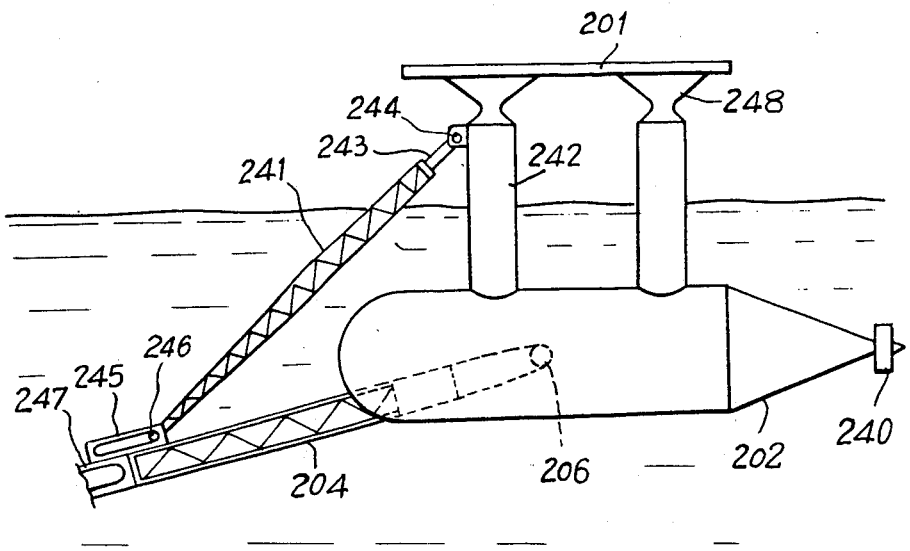
FIG. 20 is a diagrammatic elevation of an apparatus of FIG. 14 but modified to resist pack ice.

When the device described is to be employed in a sea which may be covered with ice there is connected to the arm part 204 as described in the previous embodiment a strut 241 (FIG. 20) connected by its upper end to the upper cylindrical portion of the column or columns 242 of structure by a jack pivotable about axis 244 and connected by its lower end to a carriage for pivotable movement about axis 246, the carriage being slidable along the part 204 by means of a slide 245. The jack is controlled to keep the platform 201 horizontal. If the sea may be filled with drift ice, the profile of the portion of the columns 242 located above the cylindrical portion is as described in the previous embodiment.

It will be observed that the presence of the propellers 217 on the anchoring-cap 210 enables easy correction of any swinging motion of the lower arm part 208 during connection of the cap. Transverse displacements of the arm 205 during placement are obtained by the upper propellers 227 on the main float 215, these propellers being arranged so that their thrust force is substantially in the same plane as the axis 209.

The main float 215 is normally empty when the cap is anchored. For connection and disconnection a certain volume of water is introduced into this float so that when the lower buoyant body 214 having adjustable buoyancy is full of water the arm 205 has a slightly negative buoyancy. During the course of these operations, the pilot in the chamber 221 has available to him the control of the longitudinal propellers 217 and 240, the vertical propellers 239, and the transverse propellers 216 and 227, the propellers 216, 227 and 239 enabling accurate adjustment to be effected of the lowering of the cap 210 along the vertical axis of the first enclosure.

As soon as the cap has been connected to the enclosure as explained in the above described embodiment, the main float 215 is emptied entirely and if necessary the lower buoyant body 214 is also emptied in order to increase the buoyancy of the arm 205 in order to limit the amplitude of angular movement of the arm part 208.

Disconnection of the anchoring-cap is effected by completely filling the lower buoyant body 214 with water and partially filling the float 215 with water and then proceeding as described in the preceding embodiment for a situation when the arm is under tension.

The above described second embodiment has the advantage of absorbing large compressive forces causing fatigue in the arm, as well as tensile forces.

It goes without saying that numerous additions or alterations may be made to the above described embodiment without departing from the scope of the invention. Thus all or some of the propellers might be rotatable or else be arranged in a tunnel through the arm, the access passageways in the arm 205 being deflected if necessary.

Inasmuch as the connections of the manifold in the second enclosure are identical with those described with reference to the first embodiment neither the manifold nor the pipes bringing the outflow through the arm 205 have been shown. It will be observed, however, that, because of the axial arrangement of the anchoring-cap and the manifold a rigid, rotatable and fluid-tight connection can be provided to connect the manifold to pipes provided in the cylinder 211 (FIG. 17) and extending through the articulated arm 205, with a connection passing through the cylinder 235 (FIG. 19) permitting the pipes to pass into the arm 205.

When the depth of the anchorage is not very great, apparatus identical with the first embodiment can be used but with a damper device inserted in place of the swivel joint 206 serving to connect the arm 205 to the member 202. If the apparatus is to be assumed identical with that of the first embodiment it must be understood that the arm parts 204 and 208 are in extension of one another and form a single rigid arm connecting the anchoring-cap 210 to the member 202. In accordance with this modification the damper device, of the same type as that illustrated in FIG. 10, may consist of a cylinder fast with the arm 205 inside which moves a piston dividing the cylinder into two sealed chambers containing gas. A rod fast with the piston is mounted at one end for pivotal movement about axis 206 and may pivot about its longitudinal axis. By providing two sets of pipes connecting the chambers of the cylinder to enclosures at pressure which may, if necessary, be adjusted and controlled, a simple and effective damping is achieved of compressive forces exerted upon the arm, cap and first enclosure by the impact of waves against the floating structure. Return of the piston to its original position may be effected by simple expansion of gas compressed during movement of the floating structure.

Figure 21:
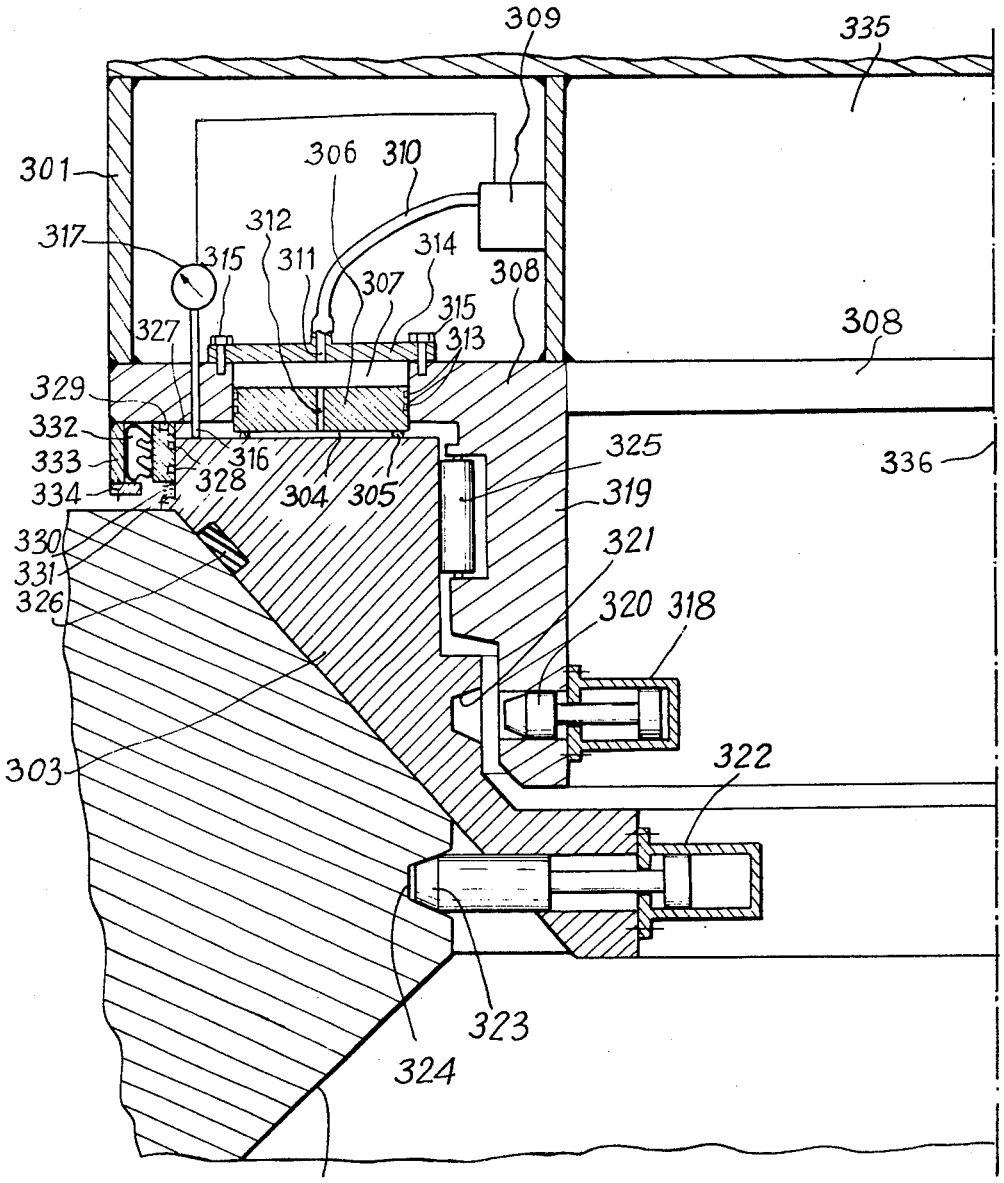
FIG. 21 is a vertical section of an alternative embodiment for connecting the cap to the enclosure.

When anchorage must be effected at great depth and the non-axial forces are large there may be advantage in employing the means of rotation illustrated in FIG. 21. In this variant the cap 301 includes an intermediate bearing-body 303 serving on the one hand as a bearing against the upper face of the enclosure 302, preferably of frustoconical shape, and on the other hand as a track for rotation with a sliding means 304. The latter may consist of a lubricating film or preferably of a film distributed across separate surfaces arranged between seals 305 and pistons 306 moving in chambers 307 distributed preferably in the annular platform 308 of the anchoring-cap 301 with which they are integral.

The lubricating film is fed at the required pressure by a pump 309 and through the feed-circuit 310 terminating in the channel 311 passing through the upper end 314 of the chamber 307. From there the lubricating fluid passes through the piston 306 by the channel 312 opening out underneath the piston. Sealing of the chamber 307 is ensured by the toroid seals 313. The surface 304 bounded by the seal 305 having a smaller area than that of the upper surface of the piston 306, the latter has a tendency to apply itself against the track formed by the upper portion of the intermediate bearing-body 303. Conversely the upper end 314 of the chamber 307 being likewise subjected to the pressure of the lubricating fluid tends to separate the annular platform 308 of the cap with which it is integrated by means, for example, of the bolts 315. The value of the separation thus created between the bearer-part 303 and the platform 308 is controlled by any suitable probe 316. The excess-separation detector-device 317 with which it is associated reacts upon the device for putting under pressure the fluid controlled by the pump 309 in order to increase the pressure if the separation is insufficient or decrease it in the opposite case. Subordinating devices of this species being known, this system has been represented on the drawing only in a purely diagrammatic form.

The intermediate bearer-body 303 is retained by jacks 318 carried by a crown-shaped extension 319 of the platform 308 during the whole descent of the cap 301 and until the latter rests by the bearer-body 303 against the frustoconical surface of the enclosure 302. During the course of this descent the head 320 of the jack 318 remains in a corresponding recess 321 in the body 303. When the jack 318 is controlled to free the intermediate bearer-body 303 this may remain applied against the enclosure 302 by control of the jack 322 which is integral with the bearer-body 303. The head 323 of this jack locks the bearer-body 303 onto the enclosure 302 by entering the seating 324 arranged in the enclosure.

Besides the jack 318 the crown 319 includes a series of rollers 325 bearing against a cylindrical race on the bearer-body 303.

After placing of the bearer-body 303 against the upper frustoconical surface of the enclosure 302 sealing of the latter is ensured by at least one fixed seal 326 preventing any infiltration of water underneath this seal as well as by at least one movable seal 327 pressed against the platform 308 under the effect of the hydrostatic pressure and blocking the gap created by the separation between the platform 308 and the intermediate bearer-surface 303 under the thrust from the fluid exerted by the pump 309. The movable seal 327 may be composed of a rubber crown including toroid seals 328 bearing against the outer cylindrical surface of the bearer-body 303 and a toroid seal 329 bearing against the bottom portion of the platform 308. In addition a spring 330 bearing against the shoulder 331 on the bearer-part 303 pushes back the seal 327 as long as the difference in pressure between the chamber 335 in the cap 301 extending the enclosure 302 and the outside environment is insufficient, that is to say, before the operation of emptying the enclosure, the seal 327 being applied after emptying, against the platform 308 and the bearer-part 303 by hydrostatic pressure. Sealing of the movable seal 327 is perfected by means of a lip seal 332 inserted between the collar 333, the platform 308 and the retainer ring 334, the hydrostatic pressure pushing the seal 327 back laterally by the lips of the seal 332.

Under the conditions illustrated in the Figure the enclosure 302 communicating with the chamber 335 in the cap has been emptied of the water which it contained, this having been replaced by air at atmospheric pressure. After application of the pressure supplied by the pump 309 under the control of the detector 317 of separation exceeding a predetermined separation between the platform 308 and the bearer-body 303 the several slideblocks formed by the pistons 306 bear against the upper track for rotation on the bearer-body 303 by means of the film 304 whilst the platform adopts the level corresponding with the selected separation. Thus the cap 301 is supported by the lubricating film and can slide while revolving about the axis 336 on the track for rotation on the bearer-body 303. All lateral forces experienced by the cap because of movements of the floating structure are therefore taken by the reaction of the cylindrical surface of the bearer-body 303 against which bear the rollers 325, so that no movable seal can be subjected to any shear force whatever. The seals 332-327-328 are in fact arranged round the bearer-body 303 and cannot be crushed against the collar 333 because of the lateral guidance exerted by the rollers 325. Any vertical wrenching forces on the cap detected by the probe 316 are automatically compensated by a reduction in the pressure supplied by the pump 309 under the control of the regulator device 317.

Thus there is achieved a reliable means of rotation whatever the external pressure and the forces transmitted by the arm connecting the anchoring-cap 301 to the following structure.

When it is required to bring the anchoring-cap back to the surface it is sufficient after refilling of the enclosure and reduction of the pressure exerted by the pump 309, to unlock the bearer-body 303 from the enclosure 302 by withdrawl of the head of the jack 322 and to relock the bearer-body 303 onto the bottom crown 319 of the platform 308 by the jack 318.

Although only a single embodiment has been described of the means of rotation of the anchoring-cap 301 which closes off the enclosure 302 in a watertight fashion, it goes without saying that numerous modifications may be applied to the whole or a part of the whole of the elements described without departing from the scope of the invention.

What is claimed is:

1. An assembly for anchorage of a floating structure comprising: a floating structure; a first enclosure having an opening at its top portion and arranged in the seabed; a movable member; means to releasably and rotatably connect said movable member to said first enclosure so as to form with said first enclosure a watertight chamber capable of being brought to atmospheric pressure, said means allowing said movable member to rotate through 360° about a vertical axis relative to said first enclosure; and rigid arm means extending from said movable member to said floating structure and pivotable about two horizontal axes by which its ends are attached respectively to said movable member and to said floating structure.

2. An assembly as claimed in claim 1, in which said first enclosure is arranged in a concrete block fixed to the seabed and passages are formed in said concrete block for pipe means for connection of a manifold located inside said first enclosure to at least one well of an underwater oil deposit.

3. An assembly as claimed in claim 2, in which the opening of said first enclosure has at least one vertical cylindrical surface, at least one conical surface in the shape of an inverted truncated cone and at least one plane surface in the form of a crown, the generatrices of which surfaces are centred on the same vertical axis.

4. An assembly as claimed in claim 3, in which a bottom portion of said movable member has at least one vertical cylindrical surface, at least one conical surface in the shape of an inverted truncated cone and at least one surface in the form of a crown the generatrices of which are centred on a single axis, the bottoms of the said cylindrical and conical surfaces of said movable member coinciding with the bottoms of the said cylindrical and conical surfaces of the opening in said first enclosure when said movable member is connected to said first enclosure.

5. An assembly as claimed in claim 4, in which the bottom portion of said movable member rests, by means of rollers attached thereto on at least one of the surfaces of said first enclosure and includes watertight joints arranged between at least one of said surfaces of said first enclosure and at least one of said surfaces of said movable member, when said movable member is connected to said first enclosure.

6. An assembly as claimed in claim 5, in which said movable member is in the form of a second enclosure open at its bottom portion and has a pump capable of emptying water from said first and second enclosures when said enclosures are connected together, and a passage controlled by a valve capable of placing said enclosures in communication with the surrounding water.

7. An assembly as claimed in claim 6, in which said second enclosure includes a chamber closed by a valve so as to be filled with air and capable of substantially instantaneously achieving the bringing into pressure balance of said chamber after connection of said enclosures by simple opening of said valve.

8. An assembly as claimed in claim 7, in which said second enclosure has at its periphery a passage kept at atmospheric pressure and communicating with the floating structure, by means of a passageway kept at atmospheric pressure and arranged inside said arm means, and with the interior of said first enclosure through a watertight door.

9. An assembly as claimed in claim 7, in which said second enclosure has at its periphery a passage kept at atmospheric pressure and communicating with the outside through a watertight door surrounded by a clamping platform for a personnel-transfer vehicle and with the interior of said first enclosure through a watertight door.

10. An assembly as claimed in claim 1, in which said movable member has mounted on its outer portion at least one horizontal-axis propeller and at least one vertical-axis propeller and is equipped with visual and electronic means to determine the location of said movable member with respect to said first enclosure.

11. An assembly as claimed in claim 2, in which said movable member includes pipework extending from said floating structure along said arm means and for connection to said manifold.

12. An assembly as claimed in claim 4, in which said bottom portion of said movable member has at its periphery vertical-axis rollers, oblique-axis rollers and jacks for controlling the application of these rollers against the corresponding cylindrical and conical surfaces of the opening in said first enclosure so as to releasably and rotatably attach the movable member to said first enclosure.

13. An assembly as claimed in claim 2, in which said concrete block has on its top portion an annular recess centred on the vertical axis of the opening in said first enclosure.

14. An assembly as claimed in claim 13, in which said movable member has mounted on its exterior, a jack extending in the vertical plane passing through the longitudinal axis of said arm means and on the side opposite to said arm means with respect to said movable member and capable of bearing against said recess.

15. An assembly as claimed in claim 14, including another jack mounted on said arm means adjacent the end by which it is connected to said movable member and extending in the vertical plane passing through the longitudinal axis of said arm means and capable of bearing against said recess.

16. An assembly as claimed in claim 1, in which said arm means includes a variable buoyancy buoyant body means for adjusting the buoyancy of said arm means and movable member.

17. An assembly as claimed in claim 15, including a jack one end of which is pivotable about a horizontal axis in the top portion of said movable member and the other end of which is pivotable about a horizontal axis in said arm means.

18. An assembly as claimed in claim 17, in which said movable member is in the form of a second enclosure and has a peripheral passage at atmospheric pressure in which are means of operation and control of all said jacks, means of checking the pressures and composition of gases in said passage, inside said second enclosure and inside said first enclosure, and means of transmission of information to said floating structure.

19. An assembly as claimed in claim 18, in which the second enclosure is adapted to receive the energy for operating its means of localization, propulsion, connection and control from said floating structure through circuits passing along said arm means.

20. An assembly as claimed in claim 19, in which said horizontal axis which connects said arm means to said floating structure is located at the bottom portion of said structure and a strut is connectd at one end to said arm means by a carriage sliding on a slide fixed on said arm means and including a bolt for immobilization of said carriage and at the other end by a constant-tension jack to a horizontal axis in the floating structure at a level higher than that of the horizontal axis of said arm means, said floating structure having at the level of its line of flotation the shape of at least one circular column the top portion of which has an axial constriction the generatrix of which is a curve substantially in the shape of a hyperbola.

21. An assembly as claimed in claim 20, in which the floating structure is semi-submersible, of variable buoyancy and includes buoyant means in which is fixed said horizontal axis of said arm means, an upper platform and a circular column supporting said platform on said buoyant means and to which is fixed said axis of attachment of said jack of said strut, said floating structure being capable of being lowered until its line of flotation passes through the level of the constricted portion of the circular column.

22. An assembly as claimed in claim 21, including at least two circular columns connecting said buoyant means to said platform, the strut taking the shape of a Y, the ends of the arms of which are attached by jacks to two corresponding columns.

23. An assembly as claimed in claim 1, in which said arm means is constituted by a single rigid arm.

24. An assembly as claimed in claim 1, in which said arm means includes damper means.

25. An assembly as claimed in claim 24, in which said damper means includes a sealed cylinder fast with a portion of said arm means extending towards said movable member, said cylinder including a piston separating said cylinder into two chambers for gas and having a rod pivotable about said horizontal axis on the floating structure.

26. An assembly as claimed in claim 25, in which said piston rod is rotatable about its longitudinal axis.

27. An assembly as claimed in claim 25, in which said chambers are connected to enclosures, the pressures in which are adjustable.

28. An assembly as claimed in claim 25, including a strut pivotable at one end portion about a horizontal axis on the floating structure and at its other end portion about a horizontal axis on said arm means, the strut including a jack operable to keep the floating structure horizontal.

29. An assembly as claimed in claim 24, in which said arm means includes an upper part and a lower part connected together for relative pivotable movement about a horizontal axis, the upper end portion of the lower part of said arm including a float of large capacity, the articulation of said arm parts constituting said damper means.

30. An assembly as claimed in claim 29, in which said float is at said upper end of said lower arm part, the length of said lower arm part being such that, when said lower arm part is vertical, said upper arm part is substantially horizontal.

31. An assembly as claimed in claim 30, in which said floating structure includes buoyant means provided with at least one propeller, the axis of thrust of which being substantially in the plane of the longitudinal axes of said upper arm part when horizontal.

32. An assembly as claimed in claim 29, in which the horizontal axis connecting said lower arm part to said movable member intersects the axis of rotation of said movable member.

33. An assembly as claimed in claim 32, in which said horizontal axis about which said upper and lower arm parts pivot lies in an upper float of said lower arm part and is offset towards said floating structure with respect to the longitudinal axis of said lower arm part.

34. An assembly as claimed in claim 33, in which said float has transverse propellers having their axis of thrust parallel with said horizontal axis in said float, said propellers being arranged on the side of said lower arm part opposite said horizontal axis and the axis of thrust of said propellers being substantially at the level of said horizontal axis.

35. An assembly as claimed in claim 29, in which said lower arm part has at least one transverse propeller having its axis of thrust parallel with the axis of articulation of said arm parts.

36. An assembly as claimed in claim 29, in which said upper arm part has, adjacent that end connected to said lower arm part, at least one propeller having its axis of thrust perpendicular to the longitudinal axis of said upper arm part.

37. An assembly as claimed in claim 29, in which said movable member has at least one propeller having its axis of thrust perpendicular to the pivot axis between said arm means and said movable member.

38. An assembly as claimed in claim 29, including a strut extending between said arm means and said floating structure and for maintaining said floating structure horizontal.

39. An assembly as claimed in claim 1 wherein the means for releasably and rotably attaching said movable members to the first enclosure includes an intermediate body located between the movable member and the first enclosure and attachable to said first enclosure; a rolling means attached to said movable member cooperating with surfaces for rolling on said intermediate body; and, sliding means provided between the said intermediate body and the said movable member.

40. An assembly as claimed in claim 39 wherein the sliding means comprises at least one lubricating film under pressure.

41. An assembly as claimed in claim 39 wherein the intermediate body includes at least one horizontal surface serving as a sliding and bearing surface for the said movable member.

42. An assembly as claimed in claim 39 the said intermediate body includes at least one vertical cylindrical surface serving as a surface for rolling of rolling means arranged on a crown-shaped extension of the bottom portion of the platform of the articulated anchoring-means.

43. An assembly as claimed in claim 39 wherein the intermediate body and movable member include means of connection having two positions, the one connecting the movable member and the intermediate body, the other freeing the intermediate body with respect to the movable member.

44. An assembly as claimed in claim 39 wherein the intermediate body and the enclosure include a means of connection having two positions, the one connecting the intermediate-body and the enclosure, the other freeing the intermediate-body and the enclosure.

45. An assembly as claimed in claim 40 wherein the lubricating film is distributed over a plurality of surfaces each bounded by a seal.

46. An assembly as claimed in claim 45 wherein each of the seals is mounted on the underface of a piston moving in a cylinder integral with the bottom platform of the movable member.

47. An assembly as claimed in claim 46 wherein each of the lubricating films is put under pressure by a feed circuit including the chamber of the cylinder in which the piston moves.

48. An assembly as claimed in claim 47 wherein the area of the upper face of the piston is greater than that of the surface of the lubricating film bounded by its seal.

49. An assembly as claimed in claim 48 wherein a probe detects the separation existing between the platform and the intermediate member, and a control means control the pressure of the lubricant as a function of the said separation.

50. An assembly as claimed in claim 39 wherein the intermediate body rests on a frustoconical surface on the upper portion of the first enclosure and has a seal located therebetween, the upper peripheral portion of the intermediate body extending its frustoconical surface consisting of a cylindrical surface edged by at least one means of sealing the annular platform of the movable member.

51. An assembly as claimed in claim 50 wherein the sealing means includes a lip seal bearing against a collar edging the annular platform of the movable member and against a crown-like seal comprising at least one toroid seal bearing against the outer cylindrical surface of the intermediate body.

52. An assembly as claimed in claim 50 wherein the crown-like seal comprises in addition a toroid joint bearing horizontally against the annular platform, a spring bearing against a shoulder on the intermediate body urging, by its top end, the said seal against the platform.

53. A method of putting into effect the means of rotation claimed in claim 39, in accordance with which an intermediate body adjoining the movable member is lowered until it rests on the upper portion of the enclosure and the said intermediate-body is loosened from the movable member.

* * * * *